United States Patent [19]

Eertink et al.

[11] Patent Number: 4,988,454

[45] Date of Patent: Jan. 29, 1991

[54] LOW PHOSPHORUS CONTAINING DETERGENT POWDERS AND PROCESS FOR PREPARING THEM: SURFACTANT, ALUMINOSILICATE, SODIUM SILICATE AND POLYACRYLATE

[75] Inventors: Jan H. Eertink, Vlaardingen; Seeng D. Liem, VR Rhoon, both of Netherlands; Antonio Malguzzi; Ronald M. Morris, both of Milan, Italy

[73] Assignee: Lever Brothers Company Division of Conopco, Inc., New York, N.Y.

[21] Appl. No.: 523,197

[22] Filed: May 14, 1990

Related U.S. Application Data

[63] Continuation of Ser. No. 30,204, Mar. 25, 1987, abandoned.

[30] Foreign Application Priority Data

Apr. 4, 1986 [GB] United Kingdom ..... 86/08291
Apr. 14, 1986 [GB] United Kingdom ..... 86/09042

[51] Int. Cl.[5] ..... C11D 3/12; C11D 11/02; C11D 17/06

[52] U.S. Cl. ..... 252/140; 252/174.23; 252/174.24; 252/DIG. 2

[58] Field of Search ..... 252/140, 174.23, 174.24, 252/DIG. 2

[56] References Cited

U.S. PATENT DOCUMENTS

| | | | |
|---|---|---|---|
| 3,753,930 | 8/1973 | Weldes et al. | 252/527 |
| 3,783,008 | 1/1974 | Weldes | 117/100 |
| 3,819,526 | 6/1974 | Pierce et al. | 252/135 |
| 3,985,669 | 10/1976 | Krummel et al. | 252/116 |
| 4,072,621 | 2/1978 | Rose | 252/89 R |
| 4,092,261 | 5/1978 | Sperling et al. | 252/131 |
| 4,136,051 | 1/1979 | Saran et al. | 252/91 |
| 4,264,464 | 4/1981 | Gangwisch et al. | 252/91 |
| 4,303,557 | 12/1981 | Rose | 252/527 |
| 4,379,080 | 4/1983 | Murphy | 252/526 |
| 4,675,124 | 1/1987 | Seiter et al. | 252/91 |
| 4,707,290 | 11/1987 | Seiter et al. | 252/140 |

FOREIGN PATENT DOCUMENTS

| | | | |
|---|---|---|---|
| 10247 | 4/1980 | European Pat. Off. | 252/135 |
| 129276 | 12/1984 | European Pat. Off. . | |
| 0129276 | 12/1984 | European Pat. Off. . | |
| 130640 | 1/1985 | European Pat. Off. . | |
| 0130640 | 1/1985 | European Pat. Off. . | |
| 0184794 | 6/1986 | European Pat. Off. . | |
| 795436A | 10/1979 | South Africa . | |
| 2097419 | 11/1982 | United Kingdom . | |

OTHER PUBLICATIONS

Kirk–Othmer Encyclopedia of Chemical Technology. Reprint from Soap and Chemical Specialties, Nov. & Dec. 1959.

*Primary Examiner*—A. Lionel Clingman
*Attorney, Agent, or Firm*—James J. Farrell

[57] ABSTRACT

Low or zero-P detergent powders are prepared by a process in which sodium aluminosilicate, a polymeric powder structurant and other components are slurried and spray-dried, and particulate sodium silicate of defined characteristics is postdosed.

9 Claims, No Drawings

LOW PHOSPHORUS CONTAINING DETERGENT POWDERS AND PROCESS FOR PREPARING THEM: SURFACTANT, ALUMINOSILICATE, SODIUM SILICATE AND POLYACRYLATE

This is a continuation of Ser. No. 030,204, filed Mar. 25, 1987, abandoned.

TECHNICAL FIELD OF INVENTION

The present invention relates to a process for preparing low or zero-phosphorus detergent powders containing alkali metal aluminosilicate as the sole or principal builder, and also containing appreciable levels of alkali metal silicate. The process of the invention combines the techniques of spray-drying and post-dosing.

BACKGROUND AND PRIOR ART

Alkali metal aluminosilicates, both crystalline (zeolites) and amorphous, are effective detergency builders which can be used to replace sodium tripolyphosphate (STP) in detergent powders, but they do not possess an ability comparable to that of STP to contribute to the structure of a spray-dried powder. Alkali metal silicates are frequently included in detergent powders as structurants, to reduce washing machine corrosion and to increase alkalinity. It is well known, however, that if aluminosilicate and silicate are together in a detergent slurry they can interact unfavourably: agglomeration of the aluminosilicate occurs to give powders containing large particles which are slow to disperse in the wash liquor, giving reduced washing performance.

EP 10 247B (Henkel KGaA) discloses a solution to this problem: silicate is omitted from the slurry, and instead is admixed subsequently with the spray-dried powder. The slurry contains aluminosilicate, surfactant and certain organic sequestrant builder materials, while the silicate is postdosed in the form of a powder having a $Na_2O:SiO_2$ mole ratio of 2.0 to 2.2, a water content of 15–23% by weight and a high water solubility. Other ingredients unsuitable for spray-drying, for example, certain nonionic surfactants, may also be postdosed.

Powders made by this process exhibit improved washing performance, since the aluminosilicate is carried through into the powder, and into the wash, in the form of small particles. The physical properties of these powders tend, however, to be poor and the powder strength low.

We have now discovered that powders of greatly improved physical properties and attractive appearance may be produced by this method if there is included in the slurry an additional powder structurant which is a polymeric material.

Zeolite-built detergent powders containing anionic polymers are disclosed, for example, in EP 137 669A, EP 130 640A, EP 66 915A, EP 124 913A, and EP 63 399A (Procter & Gamble). Low or zero phosphate powders low in silicate and structured with water-soluble salts of succinic acid and anionic polymers are disclosed in our copending application No. 85 26999 filed on 1 Nov. 1985.

GB 2 095 274A (Colgate-Palmolive Co.) discloses in Example 2B spray-dried base beads containing zeolite, sodium bicarbonate, sodium carbonate, sodium nitrilotriacetate, bentonite clay and various minor ingredients including a small amount of sodium polyacrylate (0.1% based on the final product). The beads were oversprayed with nonionic surfactant, and 2.5% of hydrous sodium silicate of similar particle size and density were post-added. The level of sodium polyacrylate in this product, however, is too low for any structuring benefit to be obtained.

SUMMARY OF INVENTION

The present invention provides a process for the production of a detergent powder having a phosphorus content of not more than 2.5% by weight and comprising one or more anionic and/or nonionic detergent-active compounds, from 10 to 60% by weight of crystalline or amorphous sodium aluminosilicate builder, from 1 to 10% by weight of water-soluble sodium silicate and optionally other conventional ingredients, the process comprising the steps of (i) spray-drying a slurry comprising the sodium aluminosilicate builder, from 0 to 2% by weight of water-soluble sodium silicate, from 0.5 to 10% by weight of a polymeric powder structurant, and optionally one or more detergent-active components, to form a powder, and (ii) admixing with the spray-dried powder from 1 to 10% by weight -of water-soluble sodium silicate in the form of a particulate solid having a $Si)_2/Na_2O$ mole ratio of from 3.0 to 1.0, a bulk density of from 400 to 1100 g/liter and a rate of solution in distilled water at 20° C. such that at least 80% by weight (of the sodium silicate) is dissolved within 1 minute and at least 95% by weight is dissolved within 3 minutes, all percentages given above being based on the final powder unless otherwise stated.

The invention further provides a detergent powder having a phosphorus content of less than 2.5% by weight and comprising one or more anionic and/or nonionic detergent-active compounds, from 10 to 60% by weight of crystalline or amorphous sodium aluminosilicate, from 1 to 10% by weight of water-soluble sodium silicate, from 0.5 to 10% by weight of a polymeric powder structurant and optionally other conventional ingredients, the powder being prepared by the process defined in the previous paragraph.

The detergent powders of the invention preferably have a phosphorus content of less than 1% by weight, and zero-P powders are especially preferred.

One class of preferred powders in accordance with the invention is constituted by high bulk density powders having bulk densities of at least 400 g/liter and agglomerate strengths (as hereinafter defined) of at least 7 $N/cm^2$ prior to the addition of the postdosed ingredients.

DETAILED DESCRIPTION OF INVENTION

The process of the invention is characterised by a combination of two features: first, use of a reduced level of silicate in the slurry, or none at all, compensated by postdosing solid sodium silicate having especially good dissolution characteristics; and secondly, inclusion of an auxiliary polymeric structurant in the slurry to make up for the loss of the structuring power of silicate in the slurry.

It is not necessary for sodium silicate to be excluded entirely from the slurry, but not more than 2% by weight of the silicate in the final powder should be incorporated in that way. Silicate processed via the slurry may of course be the usual aqueous solution (waterglass) form.

The postdosed silicate, which constitutes the whole or the greater part of the total silicate in the powder, is in the form of a particulate solid. As this could be entering the wash liquor without further processing, other than mixing with the spray-dried base powder, it must be carefully selected with respect to its rate of solution characteristics.

It has been found that optimum results have been obtained using sodium silicate having a $SiO_2$:$Na_2O$ mole ratio of from 3.0 to 1.0, preferably from 2.5 to 1.0, and a bulk density of from 400 to 1100 g/liter. It will be appreciated that the silicate ratio range given excludes neutral silicate (ratio 3.3:1) which is too highly polymerised to give adequate dissolution characteristics, but includes the more alkaline materials up to and including sodium metasilicate (ratio 1:1). The moisture content of the silicate may vary quite widely: for the amorphous alkaline silicates values of 16 to 25% by weight are typical, whereas hydrated metasilicate, with five moles of water of crystallisation per mole, generally has a moisture content of 42–44% by weight. The bulk density of the postdosed silicate is at least 400 g/liter; for the amorphous alkaline silicates a bulk density within the range of from 400 to 900 g/liter is preferred, while the bulk density of metasilicate suitable for use in the invention may be as high as 1000 g/liter.

The particulate sodium silicate used in the process of the invention is preferably prepared by spray-drying.

An especially preferred sodium alkaline silicate (ratio 2:1), prepared by spray-drying under carefully controlled conditions, is commercially available from Joseph Crosfield & Sons Ltd, UK as "Silicate A.1". The rate of solution of this material is such that at 20° C. at least 90% by weight dissolves in distilled water within 1 minute and at least 99% by weight dissolves within 3 minutes. The moisture content of "Silicate A.1" is in the 18–21% by weight range.

According to the invention a polymeric powder structurant is also incorporated in the powder by way of the slurry, in an amount of from 0.5 to 10% by weight based on the final powder.

Preferred polymeric powder structurants are water-insoluble anionic polymers, especially polymeric polycarboxylates and their derivatives. Especially preferred polymers are homopolymers and copolymers of acrylic acid and its salts.

Some polymers are also beneficial in respects other than structuring; for example, acrylic polymers have calcium binding properties. Some polymers may provide anti-ashing or antiredeposition benefits. The use of polymeric structurants that also give performance benefits of this type is especially preferred.

Suitable polymers for use in the process of the invention include the following, the list not being exclusive:

salts of polyacrylic acid, for example, Versicol (Trade Mark) E5, E7 and E9 ex Allied Colloids, average molecular weights 3500, 27 000 and 70 000 respectively; Narlex (Trade Mark) LD 30 and 34 ex National Adhesives and Resins Ltd, average molecular weights 14 000 and 72 000 respectively; and Sokalan (Trade Mark) PA 50 and PA 110S ex BASF, average molecular weights 30 000 and 250 000 respectively;

acrylic acid/maleic anhydride copolymers, for example, Sokalan (Trade Mark) CP5 and CP7 ex BASF, average molecular weights 70 000 and 50 000 respectively;

acrylic phosphinates, for example, the DKW range ex National Adhesives and Resins Ltd or the Belsperse (Trade Mark) range ex Ciba-Geigy AG, as disclosed in EP 182 411A (Unilever);

ethylene/maleic anhydride copolymers, for example, the EMA (Trade Mark) series ex Monsanto; and methyl vinyl ether/maleic anhydride copolymers, for example Gantrez (Trade Mark) AN119 ex GAF Corporation.

The first three classes of polymer are especially preferred.

Mixtures of two or more polymeric structurants may if desired be used in the process of the invention.

Detergent powders prepared in accordance with the invention exhibit better physical properties than powders containing no polymeric structurant: in particular, the agglomerate strength of the spray-dried base powder is superior. The agglomerate strength is defined as the pressure that has to be exerted on a sample of powder to compress it to a bed porosity of 0.4. The latter value has been selected since it is known to be the bed porosity of densely packed granular solids, including detergent powders: to achieve bed porosities below 0.4 any agglomerates in a powder sample have to be broken down into the primary particles of which they are composed, these primary particles corresponding in size to the droplets formed when the detergent slurry was atomised in the spray-drying tower. Thus the agglomerate strength, as its name implies, is a measure of the resistance of the agglomerates in a powder, on compression, to breakdown into the smaller primary particles.

The agglomerate strength is measured as follows. A 0.3 g sample of the 250–500 μm sieve fraction of the spray-dried base powder is subjected to compression in a compression cell of circular cross-section, having a diameter of 1.3 cm and (hence) a cross-sectional area of 1.33 $cm^2$. The work of compression is measured and plotted against the height of the powder bed in the cell.

Bed porosity as a function of bed height can be calculated from the bulk density of the powder bed (calculated from the weight of the powder sample, its height and the cross-sectional area of the compression cell), the true density of the material (solids density) and the powder porosity, by means of the following equation.

$$\text{Bulk density} = \text{solids density} \times \left[1 - \text{particle porosity}\right]\left[1 - \text{bed porosity}\right]$$

The particle porosity must be determined by air permeametry, a standard technique, using the equation derived by Carman and Kozeny in J. Society of Chemistry and Industry (London) 57, 225 T (1938).

These relationships enable a bed height corresponding to a bed porosity of 0.4 to be determined, and hence the compression required to achieve that bed height: that is the agglomerate strength.

Agglomerate strength values, which refer to the spray-dried base powder obtained from step (i) before addition of the postdosed ingredients in step (ii), depend on bulk density as well as on the formulation of the slurry, and for powders having bulk densities of 400 g/liter or above will typically be within the range of from 7 to 30 $N/cm^2$ for powders in accordance with the invention and from 4 to 6 $N/cm^2$ for powders containing no polymeric structurant. For lower bulk density powders (250 g/liter or less) the invention will normally give powders having agglomerate strengths in the 1 to 15 $N/cm^2$ range, as compared with less than 1 $N/cm^2$ for similar powders without polymeric structurant. Powders of intermediate bulk density (250–400 g/liter)

will of course give intermediate agglomerate strength values, the use of a polymeric structurant in accordance with the invention giving a proportionate improvement.

The detergent powders prepared in accordance with the invention contain sodium aluminosilicate as the sole or principal builder, in an amount of from 10 to 60% by weight based on the final powder.

The alkali metal (preferably sodium) aluminosilicate used in the composition of the invention may be either crystalline or amorphous or mixtures thereof, and has the general formula $$0.8\text{–}1.5\ Na_2O.Al_2O_3.0.8\text{–}6\ SiO_2.$$

These materials contain some bound water and are required to have a calcium ion exchange capacity of at least about 50 mg CaO/g. The preferred sodium aluminosilicates contain 1.5–3.5 $SiO_2$ units (in the formula above) and have a particle size of not more than about 100 μm, preferably not more than about 20 μm and more preferably not more than about 10 μm. Both the amorphous and crystalline sodium aluminosilicates can be made readily by reaction between sodium silicate and sodium aluminate, as amply described in the literature.

Suitable crystalline sodium aluminosilicate ion-exchange detergency builders are described, for example, in GB 1 473 201 (Henkel) and GB 1 429 143 (Procter & Gamble). The preferred sodium aluminosilicates of this type are the well-known commercially available zeolites A and X, and mixtures thereof.

The detergent powders prepared in accordance with the invention are preferably free of phosphate builders. Other inorganic or organic non-phosphate builders, for example, sodium carbonate or sodium nitrilotriacetate, may also be present, as may other inorganic salts such as sodium sulphate. Phosphate builders may be present in limited amounts, provided that the upper limit of 2.5% P is not exceeded, but as indicated previously, the invention is of especial applicability to zero-P powders.

The detergent powders prepared by the process of the present invention also contain one or more anionic and/or nonionic surfactants.

Anionic surfactants are well known to those skilled in the detergents art. Examples include alkylbenzene sulphonates, particularly sodium linear alkylbenzene sulphonates having an average chain length of about $C_{12}$; primary and secondary alcohol sulphates, particularly sodium $C_{12}$–$C_{15}$ primary alcohol sulphates; olefin sulphonates; alkane sulphonates; and fatty acid ester sulphonates. Anionic surfactants will generally be incorporated via the slurry.

Nonionic surfactants that may be used in the process and compositions of the invention include the primary and secondary alcohol ethoxylates, especially the $C_{12}$–$C_{15}$ primary and secondary alcohols ethoxylated with an average of from 3 to 20 moles of ethylene oxide per mole of alcohol. Nonionic surfactants may either be incorporated in the slurry or postdosed.

It may also be desirable to include one or more soaps of fatty acids. The soaps which can be used are preferably sodium soaps derived from naturally occurring fatty acids, for example the fatty acids from coconut oil, beef tallow, or sunflower oil. Soaps are generally incorporated via the slurry.

The total amount of detergent-active material (surfactant), excluding soap, in the detergent powders of the invention is preferably within the range of from 5 to 30% by weight. For powders intended for use in European front-loading automatic washing machines the preferred range is from 5 to 20% by weight, with a weight ratio of anionic surfactant to nonionic surfactant not exceeding 10:1, and more preferably not exceeding 6:1. When preparing powders of this type by the process of the invention, the level of sodium silicate in the slurry preferably does not exceed 1% by weight: agglomeration problems, leading to unacceptable levels of insoluble particles in the wash liquor, may be encountered at higher levels. Powders with higher ratios of anionic surfactant to nonionic surfactant can tolerate higher levels of silicate in the slurry.

Detergent compositions in accordance with the present invention may also contain any other of the ingredients conventionally present, notably antiredeposition agents; antiincrustation agents; fluorescers; enzymes; bleaches, bleach precursors and bleach stabilisers; lather suppressors; perfumes; and dyes. These may be added to the aqueous slurry or post-dosed into the spray-dried powder, either together with the silicate or separately, according to their known suitability for undergoing spray-drying processes.

The invention is further illustrated by the following non-limiting Examples.

EXAMPLES 1 TO 5

Detergent powders were prepared by slurry-making, spray-drying and postdosing from the ingredients listed below, all percentages being based on the final powder (including postdosed ingredients).

| | WEIGHT % |
|---|---|
| Via Slurry | |
| Alkylbenzene sulphonate (Na salt) | 9.0 |
| Nonionic surfactant | 4.0 |
| ($C_{12}$–$C_{12}$ 7 EO) Fatty acid soap | 1.0 |
| Zeolite | 30.0 |
| Sodium sulphate | 20.8–23.8 |
| Polymer | 0–3.0 |
| Flourescer, antiredeposition agent etc | 1.0 |
| Moisture | 10.0 |
| Postdosed | |
| Sodium silicate A.1 | 5.0 |
| Sodium perborate monohydrate | 5.0 |
| TAED granules | 3.0 |
| Bleach stabilizer (Dequest*) | 0.9 |
| Enzyme | 0.5 |
| Lather suppressor | 0.75 |
| Perfume | 0.2 |

*Trade Mark

Powders (1) to (5) containing 1–3% of various polymers, and a control powder (A) containing no polymer, were prepared, the sodium sulphate level being chosen accordingly to give a total of 100%. The bulk densities of the spray-dried base powders, before addition of the postdosed ingredients, were all in the 450–500 g/liter range.

The agglomerate strengths of the spray-dried base powders were as shown in the Table: it will be seen that the five powders prepared in accordance with the invention all gave values of 10 N/cm² or above, while the value for the control powder (A) was only 6 N/cm².

| | EXAMPLES 1 to 5 | | | | | |
|---|---|---|---|---|---|---|
| POLYMER | A | 1 | 2 | 3 | 4 | 5 |
| Polyacrylate (molecular | — | 1 | 2 | 3 | — | — |

-continued

| POLYMER | EXAMPLES 1 to 5 A | 1 | 2 | 3 | 4 | 5 |
|---|---|---|---|---|---|---|
| weight 20 000): Narlex* LD 34 ex National Adhesives and Resins Ltd | | | | | | |
| Acrylic acid/maleic anhydride copolymer: Sokalan* CP5 ex BASF | — | — | — | — | 2 | — |
| Polyacrylate/phosphinate (molecular weight 2000): DKW* 125 ex National Adhesives and Resins Ltd | — | — | — | — | — | 3 |
| Agglomerate strength ($N/cm^2$) | 6 | 10 | 10 | 16 | 10 | 12 |

*Trade Mark

We claim:

1. A process for the production of a detergent powder having 1) a phosphorous content of less than 2.5%, b) at least one detergent active compound selected from the group consisting of anionic and nonionic detergent active compounds, c) 10 to 60% of crystalline or amorphous sodium aluminosilicate builder, d) 1 to 10% of water-soluble sodium silicate and e) a homopolymer or a copolymer of acrylic acid or its salts having an average molecular weight of from about 14,000 and above as a polymeric powder structurant, which process comprises:

(1) spray-drying a slurry comprising the sodium aluminosilicate, 0.5 to 10% of the acrylic homo- or copolymeric powder structurant, by weight of the final powder, 0 to 2% water-soluble sodium silicate, by weight of the final powder and at least one said detergent active compound; and (2) admixing with said spray-dried powder obtained from step (1) from 1 to 10% by weight of particulate sodium silicate powder in the form of a particulate solid, having a $SiO_2$:$Na_2O$ mole ratio of from 3.0 to 1.0, to 1.0 to 1.0 provided that the amount of silicate admixed in step (2) is such that the total sodium silicate in the final powder does not exceed 10%, all percentages being weight percent and based on the final powder.

2. A process as claimed in claim 1, wherein the particulate sodium silicate admixed in step (2) has a $SiO_2$:$Na_2O$ mole ratio of 2.5 to 1.0.

3. The process of claim 1, wherein said sodium silicate admixed in step (2) ranges from about 5 to 10% by weight of the final powder.

4. A process as claimed in claim 1, wherein the polymeric powder structurant is selected from polyacrylates, acrylic/maleic copolymers, acrylic phosphinate polymers, and mixtures of any two or more of these.

5. A process as claimed in claim 1, wherein the particulate sodium silicate admixed in step (2) is a spray-dried material.

6. A detergent powder prepared by a process as claimed in claim 1.

7. A detergent powder as claimed in claim 6, having a phosphorus content of less than 1% by weight.

8. A detergent powder as claimed in claim 6, which is substantially free of phosphorus.

9. A detergent powder as claimed in claim 6, wherein the spray-dried powder obtained from step (1) has a bulk density of at least 400 g/liter and an agglomerate strength of at least 7 $N/cm^2$.

* * * * *